United States Patent [19]

Day

[11] Patent Number: 4,643,773

[45] Date of Patent: Feb. 17, 1987

[54] CRYSTALLIZATION OF FRUCTOSE UTILIZING A MIXTURE OF ALCOHOLS

[75] Inventor: Gary A. Day, Decatur, Ill.

[73] Assignee: A. E. Staley Manufacturing Company, Decatur, Ill.

[21] Appl. No.: 588,479

[22] Filed: Mar. 9, 1984

[51] Int. Cl.[4] ..... C13F 1/02

[52] U.S. Cl. ..... 127/30; 127/58; 127/60

[58] Field of Search ..... 127/30, 58, 60

[56] References Cited

U.S. PATENT DOCUMENTS

| | | | |
|---|---|---|---|
| 2,943,004 | 6/1960 | Haury | 127/58 |
| 3,513,023 | 5/1970 | Kusch et al. | 127/58 |
| 3,607,392 | 9/1971 | Lauer | 127/30 X |
| 3,883,365 | 5/1975 | Forsberg et al. | 127/60 |
| 3,928,062 | 12/1975 | Yamauchi | 127/60 |
| 4,199,373 | 4/1980 | Dwivedi et al. | 127/60 |
| 4,199,374 | 4/1980 | Dwivedi et al. | 127/60 |
| 4,371,402 | 2/1983 | Kubota | 127/60 |

FOREIGN PATENT DOCUMENTS

| | | | |
|---|---|---|---|
| 77919 | 2/1984 | Portugal . | |
| 2133796 | 8/1984 | United Kingdom | 127/30 |

*Primary Examiner*—Benoit Castel
*Assistant Examiner*—W. Gary Jones
*Attorney, Agent, or Firm*—Michael F. Campbell; James B. Guffey; Philip L. Bateman

[57] ABSTRACT

This invention describes the crystallization of fructose from a mixture of saccharides through the use of a mixture of ethanol and isopropanol to provide a fructose to total alcohol weight ratio of between 4:1 and 1:4 with a weight ratio of ethanol to isopropanol being between 80:20 and 98:2 and recovering crystalline fructose from the dispersion alcohol mixture.

13 Claims, No Drawings

CRYSTALLIZATION OF FRUCTOSE UTILIZING A MIXTURE OF ALCOHOLS

BACKGROUND OF THE INVENTION

1. Field of the Invention

This invention relates to obtaining fructose in high yields with a high degree of purity.

2. Description of the Art Practices

Fructose may be viewed as one-half of a sucrose molecule with the other half being dextrose (glucose). Sucrose is, of course, known commonly as table sugar and is widely used as a sweetener and structurant in many products from cake mixes to soft drinks. It has been determined that the fructose portion of the sucrose molecule has greater sweetening power on an equal weight basis than sucrose or dextrose. Therefore, if fructose is substituted into formulations, the overall cost may be lowered when compared to using sucrose. The use of fructose provides a higher degree of sweetening at a given weight level than sucrose. Thus, fewer calories are present in a fructose-sweetened product at equal sweetening levels than when sucrose is used.

Several routes have been utilized to isolate and separate fructose as a crystalline component. For the most part, fructose is prepared by isomerizing dextrose which is obtained through the refining of corn syrup. The isomerization of dextrose is generally not a 100% conversion and therefore the fructose must be separated from the remaining saccharides, e.g. dextrose, and crystallized from the aqueous dispersion.

The separation of fructose from the syrup is complicated by the high degree of solubility of the fructose in water. Therefore, the separation of fructose at acceptable purity and yield from an aqueous syrup is yet to be accomplished in a practical manner.

U.S. Pat. No. 3,607,392, issued Sept. 21, 1971, to Lauer, describes a process and apparatus for obtaining crystalline fructose through the use of methanol. Methanol has limits on its usage in food products which is the major market for crystalline fructose in the first instance.

U.S. Pat. No. 3,883,365, issued to Forsberg et al on May 13, 1975, describes a separation of fructose from glucose within a narrowly constrained pH range by lowering the temperature of the reaction mixture. The disadvantage in this process is that it is not economical to refrigerate a syrup in a plant setting. That is, the syrup will be at least at an ambient temperature during processing and the mechanics of cooling require the substantial expenditure of energy.

Yamauchi U.S. Pat. No. 3,928,062, issued Dec. 23, 1975, discloses recovering fructose by seeding anhydrous fructose crystals into a supersaturated solution of fructose. U.S. Pat. No. 4,371,402, issued Feb. 1, 1983, to Kubota, describes the dehydration of fructose utilizing an organic solvent having azeotropic behavior with respect to water.

The teachings of Dwivedi et al in U.S. Pat. No. 4,199,373, issued Apr. 22, 1980, relate to anhydrous free-flowing crystalline fructose obtained by allowing a seeded syrup to stand at low temperature and high relative humidity. U.S. Pat. No. 4,199,374, issued Apr. 22, 1980 also to Dwivedi et al suggests seeding a syrup containing fructose and allowing it to stand followed by recovery of the fructose. U.S. Pat. No. 3,513,023 to Kush, issued May 19, 1970, discloses the recovery of crystalline fructose over a broad pH range, through concentration and cooling, following seeding of the mixture.

It therefore remains to effectively separate fructose from an aqueous syrup in a high degree of purity and with a high yield. The present invention, as later described, deals with this problem effectively by using a mixture of two alcohols to separate the components to a superior degree than when using a single alcohol.

Throughout the specification and claims, percentages and ratios are by weight, temperatures are degrees Celsius, and pressures are in atmospheres over ambient unless otherwise indicated. To the extent that any of the foregoing references are applicable to the present invention, they are herein incorporated by reference.

SUMMARY OF THE INVENTION

This invention describes a process for preparing crystalline fructose from an aqueous dispersion containing fructose including:

(a) obtaining an aqueous dispersion containing on a dry solids basis at least about 85% by weight fructose;

(b) adding to the aqueous dispersion ethanol and isopropanol in a respective weight ratio of the alcohols of 80:20 to 98:2;

(c) mixing the aqueous dispersion and the alcohols until the weight ratio of the fructose to the alcohols is from about 4:1 to 1:4;

(d) allowing crystallization to occur; and, recovering the fructose.

DETAILED DESCRIPTION OF THE INVENTION

The first component of the present invention is the aqueous disperion (syrup) from which the fructose is to be crystallized. While the aqueous dispersion could consist essentially of fructose and water, it is more likely that other saccharides and various materials obtained in the processing of corn syrups will be present. Namely, dextrose will be present at from 3% to 10% by weight in the syrup. The foregoing is stated as it may be desirable in some circumstances, where highly pure fructose is desired, that crystalline fructose by redissolved in water and recrystallized according to the present invention. In any event, the amount of fructose in the syrup as described in the Summary is preferably from about 88% to about 97% by weight fructose and most preferably from about 93% to about 96% by weight on a dry solids basis (dsb). The preferred fructose source is from corn syrup, however, any source of fructose such as from inulin or other sources such as cane or beet may be employed.

The conditions for the aqueous dispersion prior to the addition of the later described alcohols are such that the pH should be from about 3.0 to about 5.0, preferably from about 3.5 to about 4.8. The temperature of the syrup and alcohol mixture prior to the crystallization step should be from about 40° C. to about 80° C., preferably from about 50° C. to about 70° C.

The alcohols utilized herein are preferably obtained in their anhydrous state. This condition is imposed as any additional water in the system will decrease the yield of fructose due to its solubility in water. The alcohols employed herein are ethanol and isopropanol. The weight ratio of the ethanol to the isopropanol is from about 80:20 to about 98:2; preferably from about 85:15 to about 97:3 and most preferably from about 90:10 to about 96:4.

It has been determined that within the foregoing ranges that the mixture of ethanol and isopropanol gives a higher yield and purity of the fructose obtained when compared to either of the alcohols utilized alone. The alcohols may be added to the syrup separately or by premixing of the alcohols. The ethanol, as it is a regulated material, may be denatured with a suitable denaturant such as methanol. Methanol is conveniently used to denature ethanol at from 1% to 10%, particularly at 5% as in 3A alcohol.

The weight ratio of the fructose in the aqueous dispersion to the alcohols is from about 4:1 to about 1:4; preferably from about 3:1 to about 1:3. The alcohol ratio to the aqueous dispersion is important in that an insufficient amount of alcohol does not allow the fructose to be effectively separated.

The mixing of the aqueous dispersion and the alcohols is conducted as near to ideal as possible. The mixing should also be continued during the crystallization step which is preferably induced by using a suitable food-grade seeding material. The preferred seeding material is crystalline fructose which may be initially obtained from a commercial source. Any other suitable sugar or saccharide may be employed, however, as the goal is to obtain a high fructose content with as high a degree of purity as possible, it is desirable to use pure fructose for the seeding. Of course, after the process is started, a portion of the product which has been crystallized as fructose may be recovered and utilized for further initiation of seeding.

The mixing of the aqueous dispersion as previously noted allows an intimate mixing of the alcohols thereby selectively extracting the fructose such that the solution structure of the water, fructose and alcohol molecules bring about favorable conditions for crystallization. Thus, when the seeding is initiated, crystallization of the dispersed fructose is extremely rapid. The use of two alcohols also reduces the viscosity of the syrup thereby facilitating mixing.

The present process may be run on a continuous basis by introducing a fresh feed stream into the mixing tank, seeding, and removing crystalline fructose slurry from the bottom of the tank. The crystallized fructose can then be drawn off, filtered, recovered as a semi-solid, and dried. Other suitable methods of recovering the fructose from the slurry can also be employed.

The present invention as described above allows for the recovery of crystalline fructose particles which average between 100 and 1,000; peferably 150 and 500 microns. Larger granules are also possible if desired. The product is of high purity when seeded with fructose and is generally suitable for all applications in which crystalline fructose is desired.

The following are suggested exemplifications of the present invention.

EXAMPLE I

Corn syrup containing 96.8% fructose on a dry solids basis is adjusted to a pH of 4.5 and evaporated under vacuum to a solids content 91.6% by weight. The remaining components in the mixture include dextrose and water.

The evaporated product in an amount of 208 parts is dissolved in 89.6 parts of an alcohol mixture which is 95:5 by weight ethanol to isopropanol. Both alcohols were essentially anhydrous prior to introduction into the system. The alcohol is added incrementally to the aqueous mixture. The resulting combination of the aqueous mixture and the alcohols is mixed vigorously at 55° C. to obtain a clear solution.

1.905 parts of crystalline fructose is then mixed with the solution and stirring continued while the mixture is cooled to 22° C. over a period of 4 hours.

The seeded mixture is then filtered and washed with three separate, 24 part aliquots of the previously described alcohol mixture at 0° C. The fructose product so recovered is air-dried to obtain 147 parts of the product which is a white crystalline powder having a purity of 99.4% by weight.

Substantially similar results are obtained by varying the alcohol mixture used above within the range as described in the Summary of the Invention. The pH of the aqueous dispersion may be varied between about 3 and about 5 with substantially similar results.

EXAMPLE II

Several comparative tests of various alcohols and alcohol mixtures are conducted according to the process described in Example I. The results are reported in Table I below.

TABLE I

| Alcohol | Product Purity[1] | % Yield[2] |
|---|---|---|
| 100% IPA[3] | 94.6 (gummy) | 90 |
| 100% ETOH[4] | 98.9–99.8 | 73 |
| 100% MEOH[5] | 99.5 | 55 |
| 5% MEOH/95% ETOH | 99.7 | 63 |
| 10% MEOH/90% ETOH | 99.3 | 51 |
| 15% MEOH/85% ETOH | 99.5 | 64 |
| 5% IPA/95% ETOH | 99.4 | 81 |
| 7% IPA/93% ETOH | 98.9 | 88 |
| 10% IPA/90% ETOH | 98.9 | 91 |
| 15% IPA/85% ETOH | 98.3 | 87 |

[1]% fructose in product.
[2]Yields of fructose.
[3]IPA is isopropanol.
[4]ETOH is ethanol.
[5]MEOH is methanol.

The tests conducted show the mixture of IPA and ETOH are most effective in increasing the purity and yield of crystalline fructose.

What is claimed is:

1. A process for recovering crystalline fructose from an aqueous fructose containing dispersion comprising providing an aqueous fructose containing dispersion having a fructose content of at least 85 percent by weight dry solids basis, admixing with said dispersion ethanol and isopropanol in an amount sufficient to provide a fructose to total alcohol weight ratio of between about 4:1 and about 1:4, the weight ratio of ethanol to isopropanol being between about 80:20 and about 98:2, crystallizing fructose from the dispersion alcohol mixture, and recovering crystalline fructose.

2. The process of claim 1 wherein the aqueous dispersion contains from about 5% to about 15% by weight water.

3. The process of claim 1 wherein the fructose is present in the aqueous dispersion at from about 88% to about 97% by weight dry solids basis.

4. The process of claim 1 wherein the aqueous dispersion also contains dextrose.

5. The process of claim 1 wherein the recovery of the fructose is enhanced by seeding the dispersion.

6. The process of claim 5 wherein the seeding is accomplished using a saccharide.

7. The process of claim 6 wherein the seeding is accomplished utilizing crystalline fructose.

8. The process of claim 1 wherein the weight ratio of the fructose to the alcohols is from about 3:1 to about 1:3.

9. The process of claim 1 wherein the weight ratio of the ethanol to the isopropanol is from about 85:15 to about 97:3.

10. The process of claim 1 wherein the mixing is continued during crystallization.

11. The process of claim 1 wherein the pH of the aqueous dispersion is between about 3.0 and about 5.0.

12. The process of claim 1 wherein the alcohols include methanol.

13. The process of claim 1 wherein the temperature is maintained between about 40° C. and 80° C. prior to the crystallization.

* * * * *